United States Patent [19]

Pfouts et al.

[11] 4,006,776

[45] Feb. 8, 1977

[54] PLATE TYPE HEAT EXCHANGER

[75] Inventors: Robert R. Pfouts, Dayton; Anson S. Coolidge; Daryl D. Peter, both of Findlay, all of Ohio

[73] Assignee: United Aircraft Products, Inc., Dayton, Ohio

[22] Filed: Mar. 31, 1975

[21] Appl. No.: 563,860

[52] U.S. Cl. ..... 165/166; 29/157.3 R; 113/118 D

[51] Int. Cl.[2] ..... F28F 3/08

[58] Field of Search ..... 165/165, 166, 153, 157

[56] References Cited

UNITED STATES PATENTS

| | | | |
|---|---|---|---|
| 2,222,721 | 11/1940 | Ramsaur et al. | 165/166 |
| 2,360,123 | 10/1944 | Gerstung et al. | 165/153 X |
| 2,392,444 | 1/1946 | Amand et al. | 165/157 |
| 2,686,154 | 8/1954 | MacNeill | 165/166 X |
| 3,266,568 | 8/1966 | Butt et al. | 165/166 |
| 3,380,517 | 4/1968 | Butt | 165/166 |
| 3,444,926 | 5/1969 | Stalberg | 165/166 |

*Primary Examiner*—Charles J. Myhre
*Assistant Examiner*—Theophil W. Streule, Jr.
*Attorney, Agent, or Firm*—J. E. Beringer

[57] ABSTRACT

A unitary plate type heat exchanger structure in which stacked core sheets, tube sheets, continuous frame members, nose pieces and corrugated fin material are joined together as by brazing to form a one-piece construction with integrated flow passages for at least one of the fluids. The parts combine with one another in a manner facilitating assembly and obviating separate attachment of a manifold means. Interior parts, including nose pieces, frame members and tube sheets are structured inherently to provide flow passages for a confined fluid. In the brazing process the parts are interconnected in a manner to resist deformation and separation of formed joints, and, means are installed to obviate the effects of high internal pressure, particularly at confined fluid inlet and outlet locations.

9 Claims, 8 Drawing Figures

FIG-1
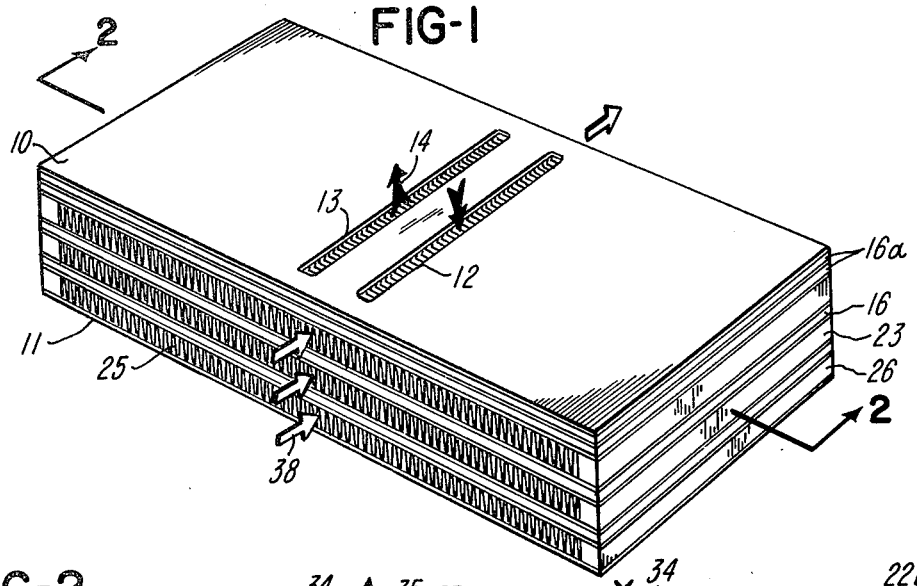
FIG-2
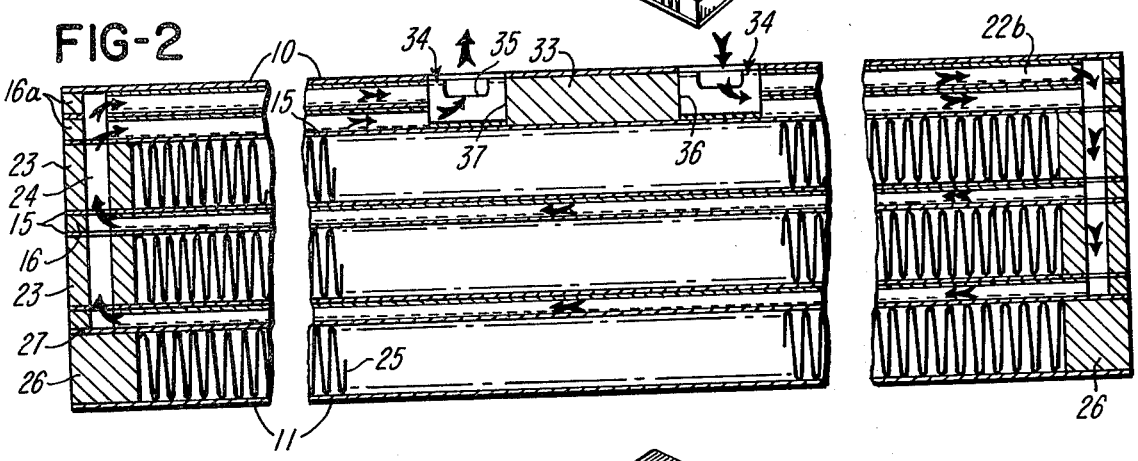
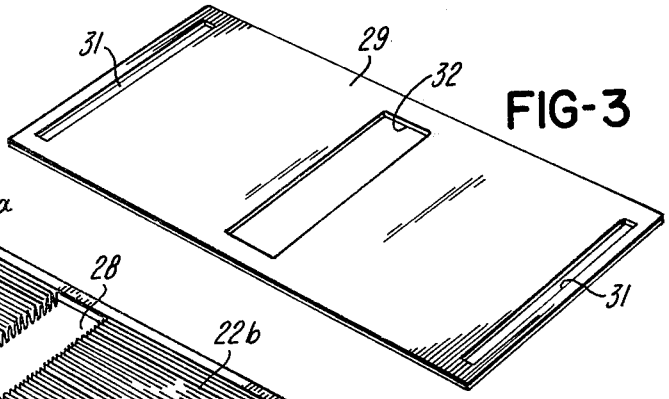
FIG-3
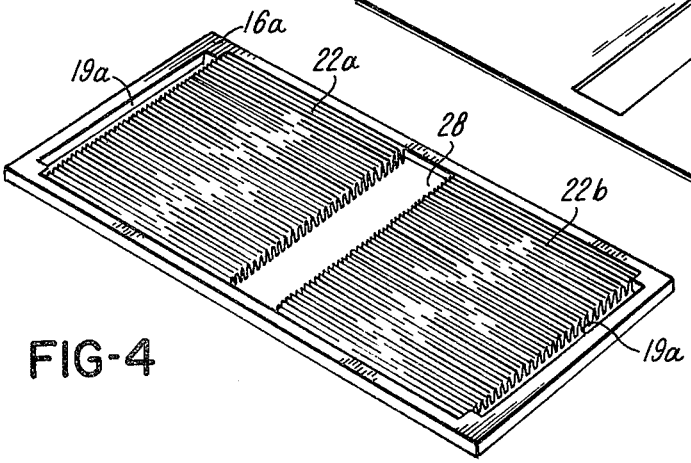
FIG-4

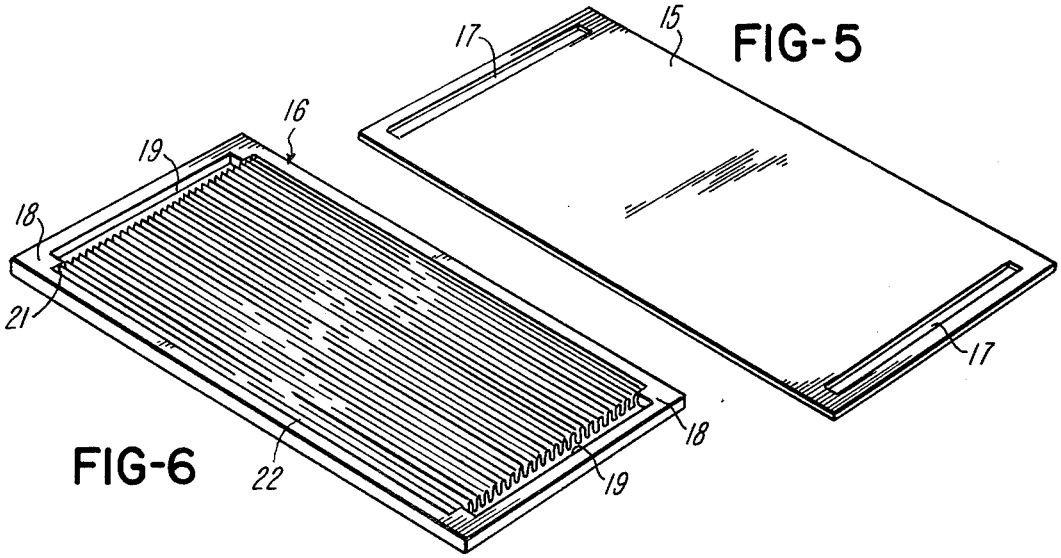
FIG-5
FIG-6
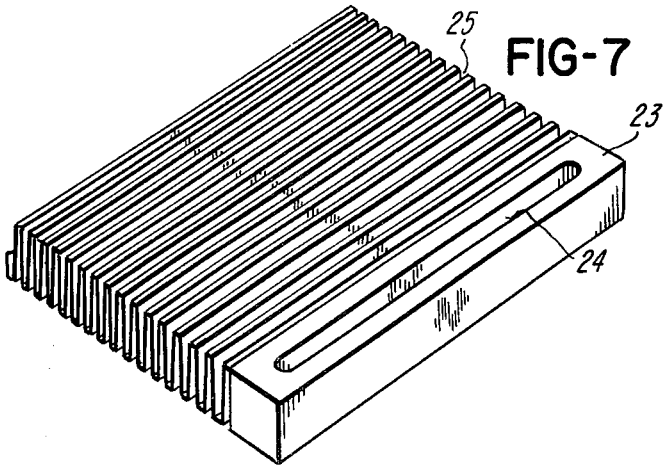
FIG-7
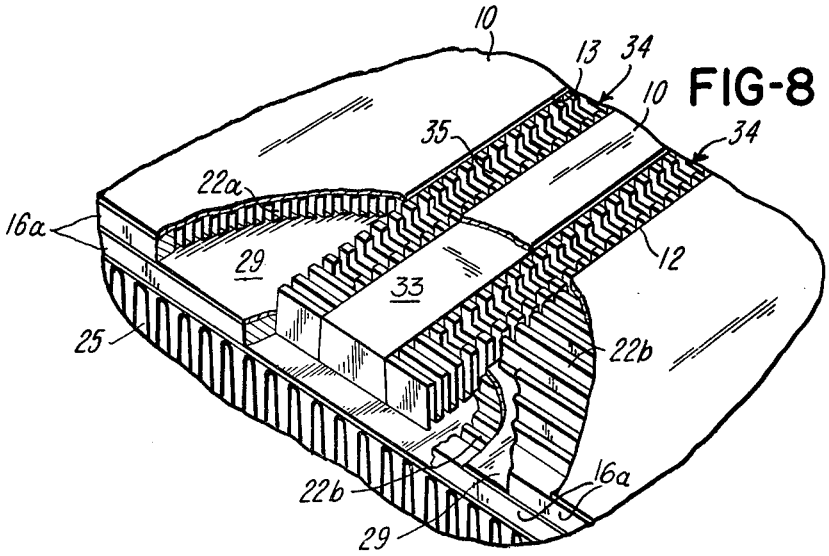
FIG-8

PLATE TYPE HEAT EXCHANGER

CROSS REFERENCE TO RELATED DISCLOSURE

U.S. Pat. No. 3,805,889 to Anson S. Coolidge issued Apr. 23, 1974 for Plate Type Heat Exchanger.

BACKGROUND OF THE INVENTION

This invention relates to plate type heat exchangers and particularly to plate and fin type heat exchangers.

Engineers and designers in the heat transfer arts turn frequently to plate and fin type heat exchangers, especially in applications coupling the need for high performance with size or volume limitations. Plate and fin heat exchangers are not, however, inherently inexpensive of construction. There are usually a large number of different parts requiring careful assembly and handling. Also, at least one of the fluids put through the heat exchanger will usually require manifolding and it is conventionally the practice to build a heat exchanger core, braze or otherwise join the parts together, and then weld or bolt separate manifold members to selected core faces. The separate manifold member, separately applied, obviously increases the total cost of the heat exchanger and affects the reliability factor in introducing a further part or parts and in adding to the number of joints required to be sealed. Further, plate and fin type heat exchangers, particularly as used in the aircraft industry, are desirably made as small and as light in weight as possible, using thin gauge plate elements which have the advantage of reduced cost as well as lower weight. This objective, however, frequently is in conflict with strength requirements of a heat exchanger which often must be constructed to withstand relatively high internal fluid pressures.

SUMMARY OF THE INVENTION

The present invention extends the benefits of plate and fin heat exchanger construction to a greater range of heat transfer applications. The proposed construction lends itself to mass production concepts and is flexible in configurations that can be achieved and in heat transfer specifications that may be met. Reliability is improved and at the same time fewer process steps and component parts are required. There is contemplated a manifold means which is integrated into the core structure in a manner to make possible an all brazed heat exchanger, that is, one in which the core and manifold are constructed as a part of a single assembly process and in a single brazing or like process are made into a unitary structure. Tube sheets and related elements are formed to provide integrated flow passages for a confined fluid. Parts are configured to achieve a mating contacting relation to one another inherently defining the provided flow passages and insuring secure joints resistant to deformation or rupture under applied internal pressure. Installed means at inlet and outlet openings for the confined fluid obviate the disruptive effect of internal pressure at these locations. Devices made according to the invention may variously be used as gas to gas, gas to liquid or liquid to liquid heat exchangers in any of many heat transfer applications but particularly those having low cost and high performance requirements, and those which desirably are made as light in weight as possible.

To provide a heat exchanger construction characterized as in the foregoing is an object of the invention.

Other objects and structural details of the invention will appear from the following description, when read in conjunction with the accompanying drawings, wherein:

FIG. 1 is a view perspective of the core structure of a heat exchanger in accordance with the illustrated embodiment of the invention;

FIG. 2 is a view in longitudinal section taken substantially along the line 2—2 of FIG. 1 and shown in a broken or interrupted form and at scale enlarged with respect to FIG. 1;

FIG. 3 is a detail view in perspective of a splitter sheet comprised in the exemplary core construction and shown at a scale reduced relative to FIG. 2;

FIG. 4 is a detail view in perspective of a frame member with confined corrugated fin material as provided in the manifold section of the core construction;

FIG. 5 is a detail view in perspective of a tube sheet;

FIG. 6 is a detail view in perspective of a frame member with confined corrugated fin material as interposed between a pair of tube sheets of FIG. 5;

FIG. 7 is a detail view in perspective of a nose piece and confined corrugated fin material; and FIG. 8 is a view enlarged with respect to FIG. 1 and partly broken away, showing a segment of the manifold section of the heat exchanger core.

Referring to the drawings, a core construction in accordance with the illustrated embodiment of the invention comprises upper and lower core sheets 10 and 11. The terms "upper" and "lower" are used herein merely for convenience and have reference to the core construction in its illustrated attitude. In use, the heat exchanger is independent of attitude. The core sheets 10 and 11 are made of a material appropriate to the fluids to be put therethrough and to the environment in which it is to be used. They are made relatively thin in keeping with an objective to provide a heat exchanger as light in weight as possible having in view the strength requirements thereof. Further, the sheets 10 and 11 will be made of a material lending itself readily to a brazing process. An aluminum alloy, stainless steel and the like may be regarded as a suitable material, again having reference to the uses and requirements of the heat exchanger.

Core sheet 11 forms a bottom wall of the heat exchanger core and is a blank sheet of material made to the desired configuration which in the illustrated instance is rectangular. Core sheet 10 is an upper sheet and is dimensioned in correspondence with sheet 11 but has intermediate its ends longitudinally spaced apart and laterally elongated openings 12 and 13. The openings 12 and 13 are in a side by side relation and function, as will hereinafter more clearly appear, as inlet and outlet openings for a confined fluid, the flow of such confined fluid being diagrammatically indicated by solid flow arrows 14.

The core of the heat exchanger is comprised, between upper and lower core sheets 10 and 11, of stacked elements including tube sheets 15, one of which is shown in FIG. 5, and frame members 16, one of which is shown in FIG. 6. Tube sheets 15 are made substantially like the core sheets 10 and 11 but have laterally elongated end apertures 17 which are fully contained within the margins of the sheet. Frame member 16 has a picture frame configuration in that it is open throughout a major part of its area and is formed with a continuous periphery. Ends of the frame member define land portions 18 and these are recessed or indented to form through apertures 19. The indented or recessed configuration of the lands 18 provide abutment shoulders 21. A strip of corrugated fin material 22 is confined between what may be regarded as sides of the frame member and have their ends reaching substantially to a contacting abutting relation to shoulders 21. The arrangement leaves apertures 19, at the ends of the fin material 22, open. The frame members 16 have a size substantially matching that of the tube sheets 15 and a superposing relationship of the parts will find apertures 17 and 19 aligned with one another.

Further comprised in the stacked assembly of parts between core sheets 10 and 11 are nose pieces 23 each having a longitudinally elongated through aperture 24. A pair of nose pieces 23 confine between them corrugated fin material 25. The latter is or may be similar to fin material 22 but is made to have a greater height than the fin material 22. In general, the fin material 22 is that most commonly associated in heat exchangers with the flow of a liquid while the fin material 25 is that most commonly associated with flow of a gas.

Still further comprised in the assembly of parts between the core sheets 10 and 11 is a pair of nose pieces 26 which are the same as nose pieces 23 except for being made without apertures 24. Also, there is a tube sheet 27 which is the same as tube sheets 15 except for being formed without the apertures 17.

Immediately beneath the upper core sheet 10 is a manifold section of the heat exchanger in which are stacked a pair of frame members **16*a* which are structurally identical to frame members 16 but in which confined corrugated fin material is differently arranged. In this instance, as shown in FIG. 4, the fin material is arranged in two strips 22*a* and 22*b* separated at their adjacent ends by a gap 28. At their outer ends, the strips 22*a* and 22*b* contact frame member shoulders in the same manner as does fin material 22 and leaves apertures 19*a*. The frame members 16*a* are separated by a splitter sheet 29 which has end apertures 31 and a central laterally elongated opening 32. The splitter sheet 29 is substantially identical to the tube sheets 15, with the addition of central aperture 32. The latter is adapted to align with gaps 28 separating fin strips 22*a* and 22*b* in the frame members 16*a*. A separator bar 33 extends transversely of the heat exchanger intermediately of inlet and outlet openings 12 and 13 and is adapted to be received in aperture 32 and related gaps 28. Also received in the aperture 32 and gaps 28, and in a flanking relation to the separator bar 33 is a pair of relatively narrow fin strips 34. Each fin strip 34 has a height substantially to equal the combined heights of the frame members 16*a* and splitter sheet 29 so as to dispose between the upper core sheet 10 and the next adjacent tube sheet 15. The fin strips 34 are made substantially like the fin material 25 but have a relatively short length. Together, the separator bar 33 and flanking fin strips 34 substantially fill aperture 32 and gaps 28, with bar 33 accordingly positioning to obviate direct or by-passing flow between the inlet and outlet openings 12 and 13. At respective inner ends, the corrugated fin material 22*a* and 22*b* has a substantially contacting relation to the corrugations of fin strips 34. The corrugations of the fin strips 34 are cut by a transverse channel 35** which has the effect of intercommunicating the spaces between adjacent corrugations of the fin strip and opening such spaces through what may be regarded as an upper face of the fin strip.

In the assembly of a core as illustrated, non-apertured nose pieces 26 are placed to overlie opposite ends of the bottom core sheet 11 and a strip of fin material 25 placed therebetween. Superposing upon this sub-assembly is the non-apertured tube sheet 27. A frame member 16, along with its confined fin material 22 is placed on tube sheet 27 and this is followed by an apertured tube sheet 15. Over this sub-assembly is placed a pair of the apertured nose pieces 23 and a strip of corrugated fin material 25 followed by another tube sheet 15. Another frame member 16, a tube sheet 15, a pair of nose pieces 23 and a final tube sheet 15 completes a stacked assembly forming a principal part of the core construction. It will be understood in this connection, that the stacking of parts is conditional upon heat transfer requirements and a greater or lesser number of flow passages may be provided as needed.

In what may be regarded as the manifold section of the heat exchanger, a pair of frame members **16*a* along with a separating splitter sheet 29 are mounted on the uppermost tube sheet 15. Within the gaps 28 and aperture 32 so provided, separator bar 33 and flanking fin strips 34 are installed. Core sheet 10** is applied to complete the assembly.

In assembly of the heat exchanger the parts are oriented and arranged to relate to one another substantially as indicated in FIGS. 1 and 2 hereof. The fin strips 34 position beneath respective inlet and outlet openings 12 and 13 and occupy what may be regarded respectively as an inlet chamber 36 and an outlet chamber 37. The frame members **16*a* and their confined fin material 22*a* and 22*b* form flow passages leading from and to respective inlet and outlet chambers 36 and 37. At their ends, the assembly comprising frame members 16*a* and splitter sheet 29 have their end apertures aligning and communicating with tube sheet end apertures 17 and nose piece apertures 24 and so define intercommunicating flow passages for the confined fluid. Thus, a fluid admitted to the heat exchanger by way of inlet opening 12 enters inlet chamber 36 and is permitted by the channel 35 and open corrugations of fin strip 34 to gain access to both superposing flow paths as defined by frame members 16*a*. The fluid flows toward one end of the heat exchanger by way of such passages and by reason of aligned communicating end apertures 19*a*, 17 and 19 is enabled simultaneously to reach the confined flow passages as represented by frame members 16. The fluid flows lengthwise of the heat exchanger or from end to end thereof between tube sheets 15 and along fin material 22 where it has similar simultaneous communication with vertically aligning apertures 17 and 19. The fluid returns upwardly through the aperture 17 in the uppermost tube sheet 15 and reenters the manifold section where it has access to flow passes as represented by the strip fin material 22*a*. The fluid flows along these superposing passages to outlet chamber 37 and discharges around fin strip 34 therein by way of outlet 35. In the illustrated instance, the heat exchanger is equipped for flow of a relatively unconfined fluid through flow passages as defined by nose pieces 23 and 26 and intermediately disposing fin material 25. The arrangement places the confined and relatively unconfined fluids in a cross flow relation and furthermore places them in a heat exchange relation, with heat being transferred from the warmer to the cooler fluid through tube sheets 15. The fin material 22 and 25 provides extended or secondary heat transfer surface and, as discussed below, has a function in reinforcing the heat exchanger against the distorting effects of internal pressure. In the illustrated instance, the heat exchanger is adapted to be oriented in confrontation to a moving current of gas which flows over the fin material 25 from front to back of the heat exchanger in the manner substantially as indicated by open arrows 38.**

The parts conventionally are assembled in a fixture which when all of the parts have been assembled in the manner described is adjusted to apply a clamping pressure urging core sheets 10 and 11 toward one another. This has the effect of assuring a close intimate contact between adjacent and superposing parts as for example in the confining of frame members 15 between tube sheets 17 and in the confining of nose pieces 23 between tube sheets 17. Desirably the fin material 22, 25, *22a*, *22b*, and 34 have an initial height slightly greater than the height assumed in a completely assembled and brazed heat exchanger. The applied pressure of overlying and underlying sheets as the parts are clamped in the fixture accordingly serves to compress the fin material, assuring its close intimate contact with such overlying and underlying sheets.

The technique of actually effecting brazing may be carried out in various ways, as for example by coating or cladding the materials of the heat exchanger with a braze alloy and by heating an assembled and fixtured heat exchanger to a temperature value sufficient to cause the braze alloy to flow without materially affecting the parent metal. Upon being allowed to harden, the braze alloy forms a seal and a bond between contacting parts, uniting the several elements of the heat exchanger into what is essentially a one-piece unitary structure. The sheets of the heat exchanger are made relatively thin, for weight reduction and for efficient heat transfer. They are accordingly, vulnerable to distortion by internal pressures in a manner which may rupture brazed joints to bring about reduced heat transfer effectiveness and leakage of the confined fluid. The pressural engagement of the sheets with the peaks and valleys of the fin material helps to reduce the likelihood of such distortion, the individual corrugations acting as ties between adjacent overlying and underlying sheets. In this connection, it will be observed that in the absence of the fin strips 34, fluid pressure in the chambers 36 and 37 could result in distortion of the upper core sheet 10 and the next adjacent tube sheet 15. The fin strips 34, however, bridge these sheets in an area immediately around the openings 12 and 13 and effectively tie the core sheet and the next adjacent tube sheet together at these locations. The result is achieved, moreover, without substantial interference with flow of the confined fluid, due to the presence of channel 35.

A fitting (not shown) may be welded or otherwise secured to the heat exchanger core in an overlying relation to upper core sheet 10 for a directed, controlled flow of the confined fluid to the inlet opening 12 and from the outlet opening 13.

The invention has been disclosed with respect to a particular embodiment. Structural modifications have been discussed and these and others obvious to a person skilled in the art to which this invention relates are considered to be within the intent and scope of the invention.

What is claimed is:

1. An all brazed heat exchanger, including:

a. upper and lower core sheets, one of which has side by side inlet and outlet openings for a first fluid, b. a plurality of tube sheets positioning between said core sheets in a separated spaced relation to said core sheets and to one another, c. at least certain of said core sheets having end apertures within the margins thereof, d. a frame member of continuous peripheral configuration positioned between tube sheets of at least one adjacent pair and indented at its ends within its margins to form end apertures registering with the end apertures in overlying and underlying tube sheets;

e. first corrugated fin material having its corrugations extending longitudinally within said frame member between shoulders as defined by end indentations therein and confined at its sides by peripheral side portions of said frame member, f. said first fin material cooperating with said frame member to define flow passage means for said first fluid, g. end nose pieces positioned to space said pair of tube sheets from an adjacent tube sheet, h. said nose pieces each having a through aperture registering with apertures in said tube sheets and in said frame member, i. second corrugated fin material having its corrugations transverse to said first fin material confined between said nose pieces and positioning between said pair of tube sheets and said adjacent tube sheet, j. said second fin material cooperating with said nose pieces and with tube sheets between which it is positioned to define flow passage means for a second fluid, k. and separator means between said one core sheet and the next adjacent tube sheet positioned to lie intermediately of said inlet and outlet openings, l. said first fluid flowing in said inlet opening to an end aperture in said next adjacent tube sheet, through an aperture in a respective one of said nose pieces and to flow passage means as defined by said first fin material and across the heat exchanger for similarly confined reverse return flow to said outlet opening, m. the defined parts being brazed into a unitary structure with peaks and valleys of said fin material in a contacting connecting relation to adjacent tube sheets with said separator means in a connecting relation to said one core sheet and said next adjacent tube sheet.

2. An all brazed heat exchanger according to claim 1, characterized by:

a. at least one frame member positioning between said one core sheet and said next adjacent tube sheet, b. and third corrugated fin material confined therein in the manner of said second fin material, c. said third fin material being in strips on opposite sides of said separator means, d. said strips having their ends adjacent said separator means spaced therefrom to define interior inlet and outlet chambers at the respective locations of said inlet and outlet openings.

3. An all brazed heat exchanger according to claim 2, characterized by:

a. means installed in each of said inlet and outlet chambers inherently to define a brazed connection between said one core sheet and said next adjacent tube sheet in the region peripheral to said inlet and outlet openings, b. said installed means having an open-work configuration facilitating a relatively free flow of said first fluid through said chambers.

4. An all brazed heat exchanger according to claim 3, wherein:

a. said installed means comprises in each instance a relatively narrow strip of fourth corrugated fin material having its corrugations extending in the same direction as the corrugations of said third fin material with its peaks and valleys contacting said one core sheet and said next adjacent tube sheet in a substantially superposing relation to respective inlet and outlet openings, b. portions of said fourth fin material contacting said one core sheet being cut away to facilitate movement of said first fluid through said fourth fin material.

5. An all brazed heat exchanger according to claim 4, wherein:

a. said fourth fin material has a channel shaped recess formed transversely of the corrugations therein in a face contacting said one core sheet, b. said recess intercommunicating the spaces defined by adjacent corrugations through said face.

6. An all brazed heat exchanger according to claim 4, characterized by:

a pair of superposing frame members with respective confined third fin material between said one core sheet and said next adjacent tube sheet, b. and a splitter sheet between said frame members, c. said splitter sheet having end apertures corresponding to and registering with end apertures in said frame members and having an intermediate aperture accommodating therein said separator means and said strips of fourth fin material, said strips of fourth fin material having a height approximately equal to the combined height of said pair of superposing frame members and interposing splitter sheets.

7. An all brazed heat exchanger, including:

a. an assembly of stacked tube sheets, extended surface means, frame members and nose pieces united by brazing into a unitary core structure, b. said assembly having integrated flow passage means for a confined fluid and inherently providing flow passage means for a second fluid to flow in heat transfer relation to said confined fluid, c. a core sheet superposing upon said assembly and having inlet and outlet openings for said confined fluid, and means between said core sheet and the next adjacent tube sheet defining an interior manifold section in open communication with said inlet and outlet openings, said integrated flow passage means defining a path of flow for said confined fluid from and back to said manifold section by way of said assembly, e. said interior manifold defining means including a separator means positioning intermediately of said inlet and outlet openings obviating direct by-passing flow of said confined fluid therebetween, and means flanking said separator means in line with resepctive inlet and outlet openings in common contact with said core sheet and said next adjacent tube sheet, f. said flanking means having an open-work configuration facilitating a relatively free flow of said confined fluid into and out of said manifold section, g. said core sheet being united by brazing with said assembly and said flanking means acting as ties between said core sheet and said adjacent tube sheet in regions peripherally of said inlet and outlet openings.

8. An all brazed heat exchanger according to claim 7, wherein:

a. separate strips of corrugated fin material position in said interior manifold section on opposite sides of said separator means and in spaced relation thereto, b. said flanking means having the form of further relatively narrow strips of corrugated fin material positioning between respective separate strips of fin material and said separator means and being cut away to facilitate movement of said confined fluid from and toward said inlet and outlet openings.

9. An all brazed heat exchanger as in claim 8, wherein:

a. the corrugations of said further relatively narrow strips of fin material are cut by a transverse channel, b. and the inlet and outlet openings in said core sheet are relatively narrow elongated apertures substantially aligning with respective transverse channels.

* * * * *